US005709579A

United States Patent [19]

Ji et al.

[11] Patent Number: 5,709,579

[45] Date of Patent: Jan. 20, 1998

[54] ELECTROSTATIC CHARGER AND PROCESS THEREFOR

[75] Inventors: Hang-ku Ji, Kyonggi-do; Young-man Kim, Seoul, both of Rep. of Korea

[73] Assignee: Samsung Display Devices Co., Ltd., Kyonggi-do, Rep. of Korea

[21] Appl. No.: 570,483

[22] Filed: Dec. 11, 1995

[30] Foreign Application Priority Data

Dec. 14, 1994 [KR] Rep. of Korea ..... 94-34218

[51] Int. Cl.[6] ..... H01J 9/227

[52] U.S. Cl. ..... 445/52; 250/326

[58] Field of Search ..... 445/52; 250/324, 250/326

[56] References Cited

U.S. PATENT DOCUMENTS 083,959 1/1868 Datta et al. ..... 445/52

5,519,217 5/1996 Wilbur, Jr. et al. ..... 250/326

*Primary Examiner*—Kenneth J. Ramsey

*Attorney, Agent, or Firm*—Christie, Parker & Hale, LLP

[57] ABSTRACT

Disclosed is an electrostatic charging apparatus for electrostatically charging the inside surface of the screen panel of a color cathode ray tube to make powdery phosphor to be applied to the inside surface by the electrical attraction, which comprises a corona charger for electrostatically charging the inside surface, a stand frame for supporting the corona charger, a mounting means for supporting the screen panel with the part of the inside surface of the display being wholly exposed to the corona charger with a space therebetween, and a power supply for supplying a high voltage to the corona charger, wherein the corona charger has a convex surface with a plurality of charging electrodes uniformly distributed.

8 Claims, 4 Drawing Sheets

ELECTROSTATIC CHARGER AND PROCESS THEREFOR

TECHNICAL BACKGROUND

The present invention concerns an electrostatic charging apparatus for electrostatically charging the inside surface of the screen panel of a color cathode ray tube (CRT) to make powdery phosphor to be applied to the inside surface by the electrical attraction, and process therefor.

U.S. Pat. No. 5,083,959 discloses the electrostatic charging apparatus which reciprocates electrostatically charging the screen panel. Referring to FIG. 1 for illustrating a conventional electrostatic charging apparatus, the screen panel 20 of a CRT is fixedly mounted on a panel support surface 18 of a support frame 17 by a panel fixing device 19. A control panel 11 controls the electrostatic charging apparatus with a voltmeter 12 for displaying the voltage applied to a corona charger 21, which electrostatically charges the screen panel 20. The corona charger 21 is mounted on a mounting rod 25 supported by a support part 27. A drive screw 26 is driven by a motor 16 to move the mounting rod 25 for the screen panel 20 to be uniformly charged through the whole surface. The motor 16 is controlled by a motor controller 14. The timer 13 is provided to adjust the number of the reciprocating motions of the corona charger 21 across the screen panel 20. The corona charger 21 is supplied with a high voltage from a high voltage power supply (HVPS) 15. A panel ground electrode 22 is connected between the support frame 17 and a conductive layer of the panel 20. An electrostatic voltage detection probe 23 measures the amount of the charge formed on the inside surface of the screen panel 20. The probe 23 is moved by a probe drive 24 close to the inside surface of the screen panel 20. Reference numeral 28 represents a cable 28 for transferring the voltage of the HVPS 15 to the coronal charger 21. The controller 11 controls the reciprocating movements of the corona charger 21 to electrostatically charge the inside surface of the screen panel 20.

In such conventional electrostatic charging apparatus, the charging process is sequentially carried out starting from one side portion of the screen panel, and therefore previously charged portions inadvertently tend to discharge so as to impair the charging uniformity of the inside surface of the screen panel, and the time taken for the charging process is increased. In addition, since the inside surface of the screen panel has a curvature different from the curvature at which the corona charger draws a curve while performing the reciprocating movements, the amount of the charge formed in the central portion of the inside surface of the screen panel becomes different from that in the portions near the boundary of the inside surface, thus making it difficult to adjust the charging amount. Moreover, the reciprocating motion of the corona charger may cause safety problems.

SUMMARY OF THE INVENTION

It is an object of the present invention to provide a corona charger for uniformly charging electrostatically the inside surface of the screen panel.

It is another object of the present invention to provide a corona charger which need not make reciprocal movements to perform the charging operation, thus decreasing the time taken for the charging operation and improving safety.

According to an embodiment of the present invention, there is provided an electrostatic charging apparatus for electrostatically charging the inside surface of the screen panel of a color cathode ray tube in preparation for receipt of powdery phosphor by the electrical attraction to the screen panel, the apparatus comprises a corona charger for electrostatically charging the inside surface, a stand frame for supporting the corona charger, a mounting means for supporting the screen panel with the display effective part of the inside surface being wholly exposed to the corona charger with a space therebetween, and a power supply for supplying a high voltage to the corona charger, wherein the corona charger has a convex surface with a plurality of charging electrodes uniformly distributed.

Preferably, the corona charger comprises a conductive base with a plane size substantially equal to that of the inside surface, a plurality of sector-like shaped grounding electrodes arranged in parallel on the conductive base with a space between adjacent ones of the grounding electrodes, and a plurality of sector-like shaped insulating holders each inserted into the space for respectively holding a plurality of sector-like shaped charging electrodes. The upper ends of the grounding electrodes and the upper ends of the insulating holders are designed such that together they form a convex surface, and the charging electrodes each have a sawtooth tip uniformly protruding from the surrounding convex surface.

According to another embodiment of the present invention, there is provided a process for electrostatically charging the inside surface of the screen panel of a color cathode ray tube by employing the above described inventive electrostatic charging apparatus, which comprises the steps of:

- positioning the screen panel relative to the corona charger;
- defining a predetermined amount of charge to be applied to the inside surface;
- setting the duration for the corona charger to work in order to apply charge to the inside surface;
- operating the corona charger;
- measuring the amount of the charge applied to the inside surface at the end of the operation in order to make a decision whether or not the amount exceeds the predetermined amount;
- stopping the operation of the corona charger when the amount exceeds the predetermined amount;
- making a decision whether or not the duration is passed when the amount is smaller than the predetermined amount;
- continuing the operation of the corona charger when the duration is not passed; and
- setting a new duration for the corona charger to additionally work when the duration is passed.

The present invention will now be described more specifically with respect to the drawings attached only by way of example.

BRIEF DESCRIPTION OF THE ATTACHED DRAWINGS

Figure 4A:
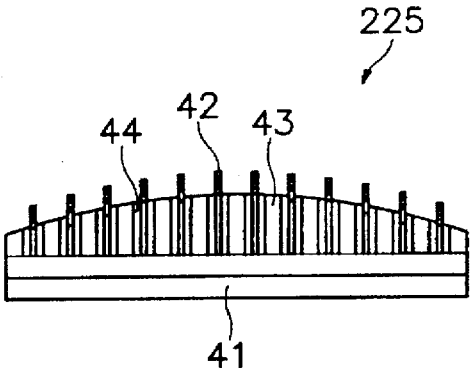
Figure 4B:
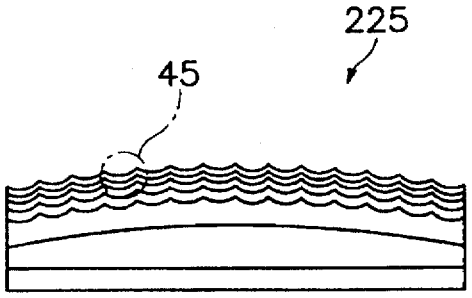
Figure 5:
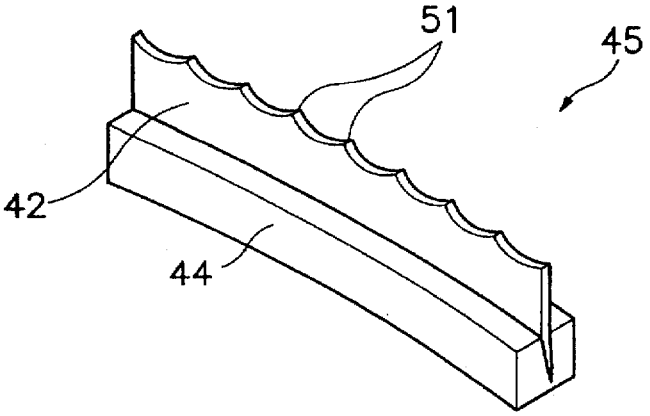
Figure 6:
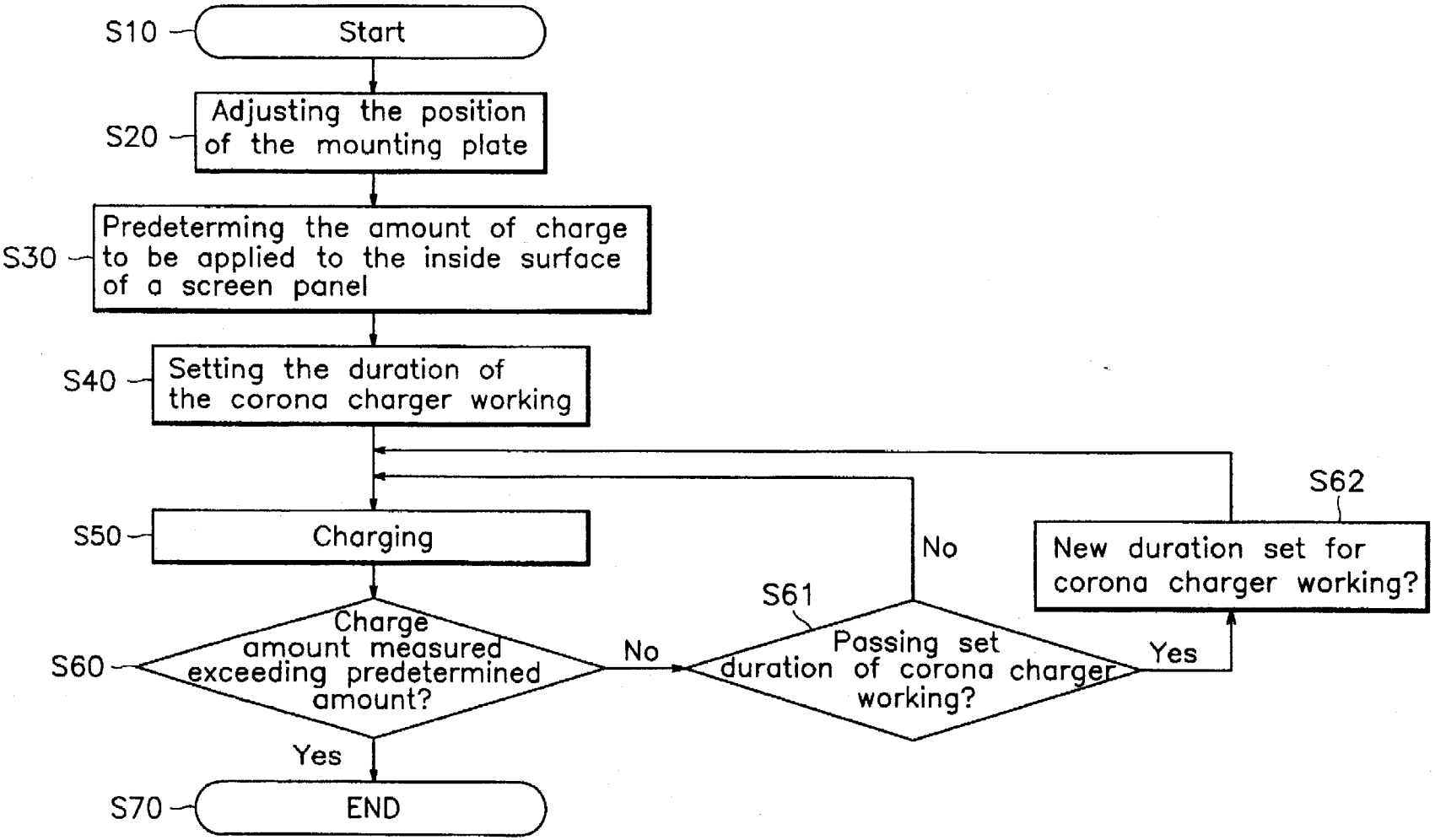

FIGS. 4A and 4B schematically illustrate a diagram of the structure of a corona charger according to an embodiment of the present invention;

FIG. 5 illustrates an enlarged view of a plurality of sector-like shaped charging electrodes of a corona charger according to the embodiment of the present invention; and FIG. 6 is a flow chart for illustrating a process for electrostatically charging the inside surface of the screen panel of a CRT according to another embodiment of the present invention.

DETAILED DESCRIPTION OF PREFERRED EMBODIMENTS OF THE PRESENT INVENTION

Figure 1:
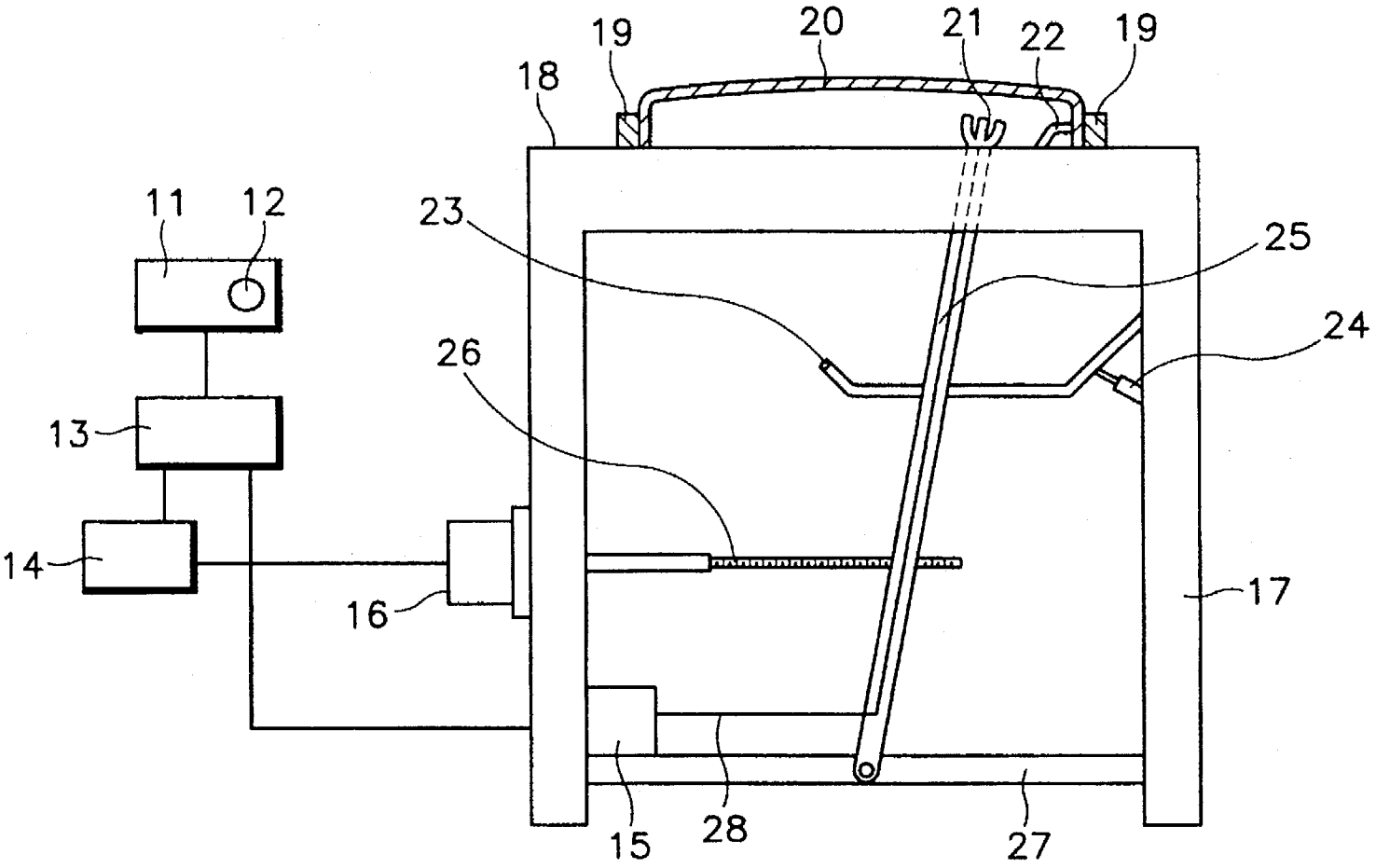
FIG. 1 (Prior Art)
FIG. 1 is a schematic diagram for illustrating a conventional electrostatic charging apparatus for electrostatically charging the inside surface of the screen panel of a CRT.
Figure 2:
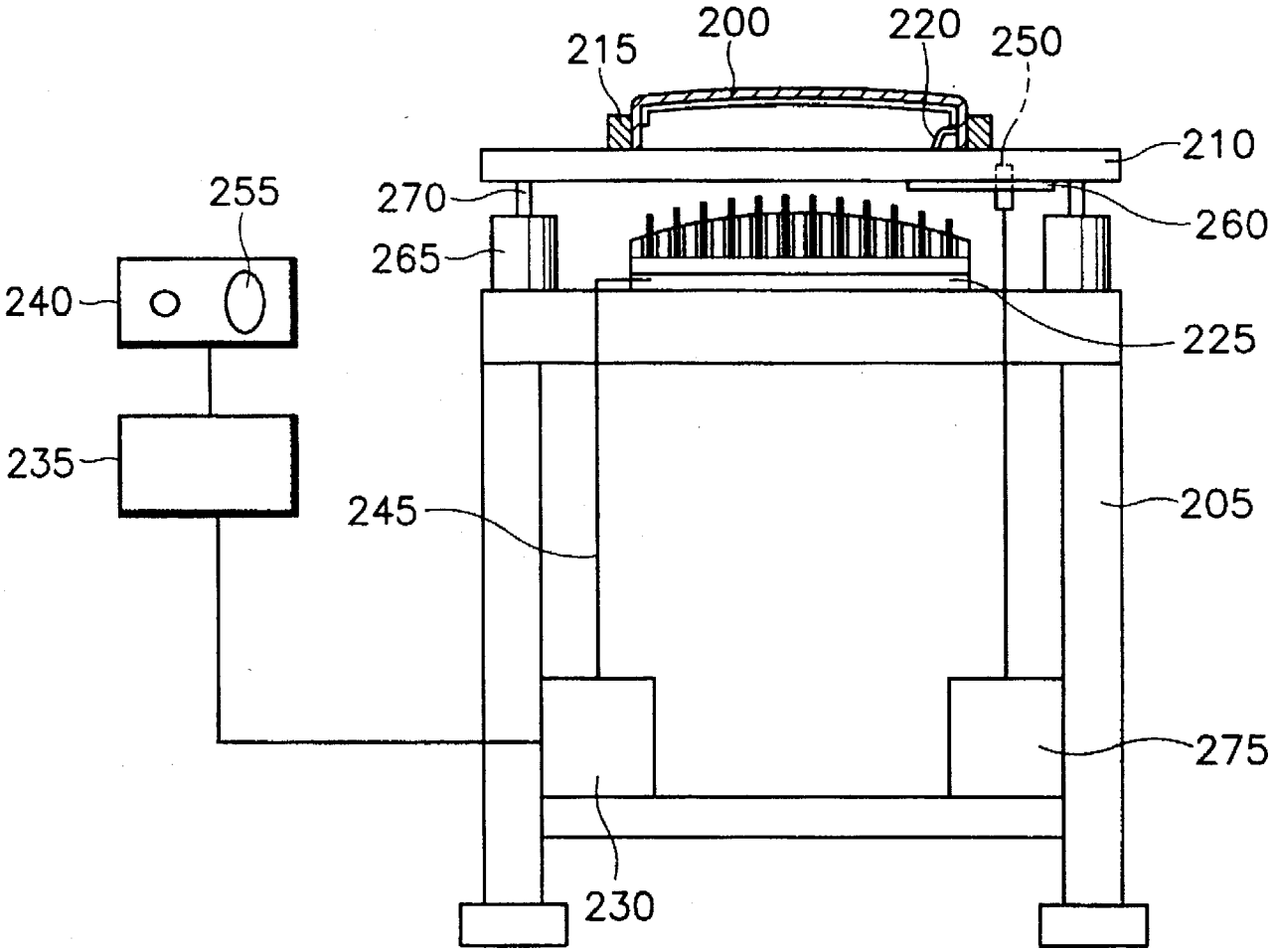
FIG. 2 is a schematic diagram for illustrating electrostatic charging apparatus and embodying the present invention.

Referring to FIG. 2, the screen panel 200 is mounted on a mounting plate 210 with panel fixing devices 215 for fixing the screen panel. A pair of lifts 270 are arranged beneath two opposite side portions of the mounting plate 210 for raising or lowering the mounting plate in respect to a corona charger 225. A mounting plate guide block 265 is provided to guide the lifts 270. The coronal charger 225 is supplied with a high voltage via a cable 245 from a high voltage supply 230. Also provided is a controller 240 for controlling the amount of the charge formed on the inside surface of the screen panel and the time taken for the charging operation. The voltage applied to the corona charger 225 is displayed on a voltmeter 255 installed in the controller 240. A timer 235 is provided to generate a signal applied to the high voltage supply 230 to adjust the time taken for the charging operation of the corona charger 225. A measuring probe 250 is also provided to measure the amount of the charge formed on the inside surface of the screen panel 200 and moved by a probe drive 260 close to the inside surface of the screen panel 200. All the components of the inventive structure are supported by a support frame 205.

Figure 3:
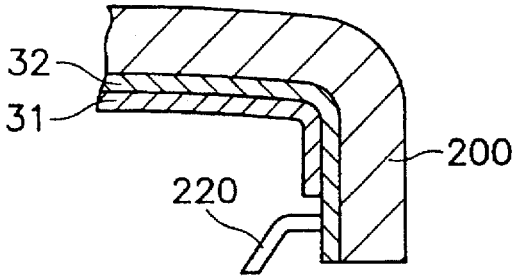
FIG. 3 is an enlarged schematic diagram for illustrating a grounding electrode connected with the screen panel.

A panel grounding electrode 220 is connected between the conductive layer of the screen panel 200 and the support frame 205. As shown in FIG. 3, the conductive layer 32 is interposed between an optical conductive layer 31 and the inside of the screen panel 200. The panel conductive layer 220 is preferably connected with the conductive layer 32 by means of a spring (not shown).

The corona charger includes, as shown in FIGS. 4A and 4B, a conductive base 41 with a plane size substantially equal to that of the inside surface of the screen panel 200, a plurality of sector-like shaped grounding electrodes 43 arranged in parallel on the conductive base 41 with a space between adjacent ones of the grounding electrodes 43, and a plurality of sector-like shaped insulating holders 44 each inserted into the space for respectively holding a plurality of sector-like shaped charging electrodes 42. The upper ends of the grounding electrodes and the upper ends of the insulating holders are designed so as when together form a convex surface, and the charging electrodes each have a sawtooth tip uniformly protruding from the surrounding convex surface. The curvature of the surface formed by connecting the upper ends of the charging electrodes 42 is designed to be the same as that of the convex surface. The curvature of the convex surface is preferably made the same as or larger than the central curvature of the inside surface of the panel screen 200. The central curvature of the inside surface of a 14" screen panel is 55.1 cm. The number of the charging electrodes is preferably seven or ten. The sawtooth tip has a plurality of pin-type projections 51, as shown in FIG. 5.

Referring to FIG. 6, the screen panel 200 is properly positioned in steps S10 and S20 over the corona charger 225 by adjusting the position of the mounting plate 210 by means of the lifts 270, in step S20. The distance between the corona charger 225 and the inside surface of the screen panel 200 is preferably 2 to 6 cm. The controller 240 predetermines the amount of charge to be applied to the inside surface of the screen panel 200 in step S30 and sets the timer 235 for the duration for the corona charger 225 to work in order to apply charge to the inside surface in step S40. Then, the charging process is performed in step S50.

At the end of the duration, the amount of the charge applied to the inside surface of the screen is measured in step S60 in order to make a decision whether or not the amount exceeds the predetermined amount. When the amount exceeds the predetermined amount, the operation of the corona charger is stopped in step S70. When the amount is smaller than the predetermined amount, a decision is made in step S61 whether the duration is passed or not. When the duration is not passed, the operation of the corona charger continues by returning to the step S50. But, when the duration is passed, a new duration is set in step S62 for the corona charger to additionally work by returning to the step S50.

The panel grounding electrode 220 and the sector-like shaped grounding electrodes have the same ground level voltage. The voltage applied to the charging electrodes 42 is 8 to 10 KV higher than the ground voltage, and the total ion current is 0.2 mA. By employing the inventive apparatus, the charging duration is taken about 15 seconds for forming an electrostatic voltage of 200V to 800V on the optical conductive layer 31.

What is claimed is:

1. An electrostatic charging apparatus for electrostatically charging an inside surface of a screen panel of a color cathode ray tube in preparation for receipt of powdery phosphor by electrical attraction to the screen panel, comprising a corona charger for electrostatically charging said inside surface, a stand frame for supporting said corona charger, a mounting means for supporting said screen panel with a display effective part of said inside surface being wholly exposed to and displaced from said corona charger, and a power supply for supplying a high voltage to said corona charger, said corona charger comprising a convex surface with a plurality of uniformly distributed charging electrodes.

2. An electrostatic charging apparatus as defined in claim 1 wherein said mounting means comprises a mounting plate, disposed over the convex surface of said corona charger for fixedly mounting said screen panel, and comprising an opening to expose said display effective part to said plurality of charging electrodes, and a pair of lifts arranged beneath two opposite side portions of said mounting plate for raising or lowering said mounting plate with respect to said corona charger.

3. An electrostatic charging apparatus as defined in claim 1 or 2, wherein said corona charger comprises a conductive base with a plane size substantially equal to that of said inside surface, a plurality of sector-like shaped insulating holders each inserted into said space for respectively holding a plurality of Said sector-like shaped charging electrodes, upper ends of said grounding electrodes and upper ends of said insulating holders being designed such that together they form said convex surface, and said charging electrodes each having a sawtooth tip uniformly protruding from the surrounding convex surface.

4. An electrostatic charging apparatus as defined in claim 1 or 2 wherein said convex surface has a curvature extending equal to or larger than that of said inside surface.

5. An electrostatic charging apparatus as defined in claim 3 wherein said convex surface has a curvature extending equal to or larger than that of said inside surface.

6. An electrostatic charging apparatus as defined in claim 1 wherein said screen panel is grounded.

7. In an electrostatic charging apparatus for electrostatically charging the inside surface of the screen panel of a color cathode ray tube to make powdery phosphor to be applied to said inside surface by electrical attraction, the apparatus comprising a corona charger for charging said inside surface, a stand frame for supporting said corona charger, a mounting means for supporting said screen panel with the display effective part of said inside surface being wholly exposed to said corona charger with a space therebetween, and a power supply for supplying a high voltage to said corona charger, wherein said corona charger has a convex surface with a plurality of uniformly distributed charging electrodes, a process for controlling said electrostatic charger comprising the steps of:

positioning said screen panel relative to said corona charger;

predetermining the amount of charge to be applied to said inside surface;

setting the duration for said corona charger to work in order to apply charge to said inside surface;

operating said corona charger to apply the charge to the inside surface;

measuring the amount of the charge applied to said inside surface at the end of said duration in order to make a decision whether or not said amount exceeds the predetermined amount;

stopping the operation of said corona charger when said amount exceeds said predetermined amount;

making a decision whether or not said duration is passed when said amount is smaller than said predetermined amount;

continuing the operation of said corona charger when said duration is not passed; and setting a new duration for said corona charger to additionally work to apply charge to said inside surface when said duration is passed.

8. A process as defined in claim 7 wherein said screen panel is, while operating is spaced at 2 to 6 cm relative to said corona charger for the charging operation.

* * * * *